US005368292A

United States Patent [19]

Metz

[11] Patent Number: 5,368,292

[45] Date of Patent: Nov. 29, 1994

[54] BASKETBALL REBOUNDING SYSTEM

[76] Inventor: Douglas Metz, 155 A Lakehill Rd., Burnt Hills, N.Y. 12027

[21] Appl. No.: 168,679

[22] Filed: Dec. 16, 1993

[51] Int. Cl.[5] ..... A63B 63/08

[52] U.S. Cl. ..... 273/1.5 A

[58] Field of Search ..... 273/1.5 R, 1.5 A, 394, 273/396

[56] References Cited

U.S. PATENT DOCUMENTS

| | | | |
|---|---|---|---|
| 3,901,506 | 8/1975 | Caveney | 273/1.5 A |
| 3,913,916 | 10/1975 | Martin, Jr. | 273/1.5 A |
| 4,786,053 | 11/1988 | Barnes | 273/1.5 R |
| 4,836,539 | 6/1989 | Knapp | 273/1.5 A |
| 4,936,577 | 6/1990 | Kingston | 273/1.5 A |
| 4,955,605 | 9/1990 | Goldfarb | 273/1.5 A |
| 5,165,680 | 11/1992 | Cass | 273/1.5 A |
| 5,171,009 | 12/1992 | Filewich et al. | 273/1.5 A |
| 5,184,814 | 2/1993 | Manning | 273/1.5 A |

*Primary Examiner*—William H. Grieb

*Attorney, Agent, or Firm*—Schmeiser, Morelle & Watts

[57] ABSTRACT

A basketball rebounding system for capturing a basketball which has been shot in the general direction of a basketball hoop, and for subsequently returning the basketball to the shooter, regardless of the successful completion of a basket. The basketball rebounding system generally includes a slotted basketball capturing structure for substantially enclosing the front, sides and bottom of a conventional basketball hoop and backboard arrangement, and a return mechanism for returning a captured basketball to the shooter thereof substantially along the original flight path of the basketball.

16 Claims, 4 Drawing Sheets

BASKETBALL REBOUNDING SYSTEM

FIELD OF THE INVENTION

The present invention relates to the sport of basketball and, more particularly, to a basketball rebounding system for a conventional basketball hoop and backboard arrangement. Advantageously, unlike the basketball rebounding systems of the prior art, the present invention is adapted to automatically return a basketball to a player, even when the basketball does not successfully pass through the basketball hoop. More specifically, unsuccessful shots, which would normally ricochet away from a player after bouncing off the backboard and/or rim of the basketball hoop, are automatically returned, substantially eliminating the annoying ball chasing commonly experienced when shooting basketballs toward a conventional basketball hoop and backboard arrangement.

BACKGROUND OF THE INVENTION

To become proficient at the sport of basketball, and to improve shooting accuracy and technique, a player must often spend endless hours shooting basketballs toward a basketball hoop. When an assistant or fellow player is available to rebound a missed shot, shooting generally continues in a substantially periodic and efficient manner. However, as is often the case, many players spend a disproportionate amount of time practicing alone, and are necessarily required to chase after not only those shots which have been deflected away by the basketball hoop or associated backboard, but also those shots which have successfully passed through the basketball hoop.

Heretofore, many basketball rebounding systems have been developed to increase the effectiveness of individual practice sessions. Unfortunately, each of these systems have been specifically designed to selectively return a basketball in response to a completed basket; any basketballs which have not passed through an associated basketball hoop are not returned and must be chased after and manually retrieved by the shooter. Further, such systems are usually secured directly to the rim of the basketball hoop, potentially adversely influencing the inherent resilience of the hoop and the corresponding reaction of a basketball impacting thereagainst.

SUMMARY OF THE INVENTION

In order to avoid the disadvantages of the prior art, the present invention provides a basketball rebounding system for capturing a basketball which has been shot in the general direction of a basketball hoop, and for subsequently returning the basketball to the shooter, regardless of the successful completion of a basket.

In accordance with a first embodiment of the present invention, the basketball rebounding system includes a net structure for substantially enclosing the front, sides and bottom of a conventional basketball hoop and backboard arrangement, and a return mechanism for returning a captured basketball toward the shooter, substantially along the original line of flight. More specifically, the net structure includes first and second outwardly projecting side portions, each having a distal end which extends outwardly beyond the front rim of the basketball hoop, an anterior, slotted ball entry portion, extending between the distal ends of the first and second outwardly projecting side portions, and a bottom portion for directing a captured basketball toward the return mechanism. Preferably, the net structure comprises a foraminous netting material which is shaped and supported by a substantially rigid and lightweight framework formed of one-inch PVC tubing or the like. Analogously, the return mechanism preferably comprises a substantially rigid, elongated, arcuate chute formed from a section of PVC tubing having a width and curvature sufficient to guide, support, and return a captured basketball toward the shooter thereof.

The anterior, slotted ball entry portion of the net structure includes a slot having a width slightly larger than the diameter of a standard, regulation size basketball. When the net structure is appropriately mounted to a conventional basketball hoop and backboard arrangement, the slot is fixedly and centrally disposed in front of the basketball hoop. Consequently, a basketball must pass substantially perpendicularly through the slot before encountering the basketball hoop and/or backboard. Thereafter, once captured by the surrounding net structure, the basketball is directed toward the shooter by the return mechanism, substantially along the original flight path of the basketball. As should be readily apparent to those skilled in the art of basketball, the configuration of the above-described basketball rebounding system is highly suited for the practice of "free throws" and other perpendicularly directed shots.

The bottom portion of the net structure is designed to capture a basketball which has passed through the slot in the anterior portion of the net structure, and to subsequently direct the captured basketball downward through an aperture onto the return mechanism. Preferably, the aperture is disposed beneath the basketball hoop, and has a diameter slightly larger than the diameter of a conventional basketball.

A second embodiment of the present invention incorporates a slotted, rotatable structure for enclosing the front and sides of a conventional basketball hoop and backboard arrangement, and a netted bottom portion for directing a captured basketball toward a rotatable return mechanism. More specifically, the slotted, rotatable structure includes a substantially annular track for engaging a coupled series of upwardly extending, horizontally movable supports, each formed of a rigid, sturdy, lightweight material, and a slot, formed by a contiguous subset of the upwardly extending, horizontally movable supports, for receiving a basketball therethrough. Advantageously, the slot is adapted to be manually rotated through an arc of up to 180° around the annular track in response to a rotation of the movable supports, thereby allowing a shooter to practice shots from various positions about the basketball hoop. Correspondingly, the return mechanism may be rotatably positioned perpendicularly beneath the slot to direct a captured basketball toward the shooter, substantially along the original flight path of the basketball.

BRIEF DESCRIPTION OF THE DRAWINGS

These and other features of the present invention will become readily apparent upon reading the following detailed description, and upon reference to the drawings in which.

DETAILED DESCRIPTION OF THE INVENTION

Figure 2:
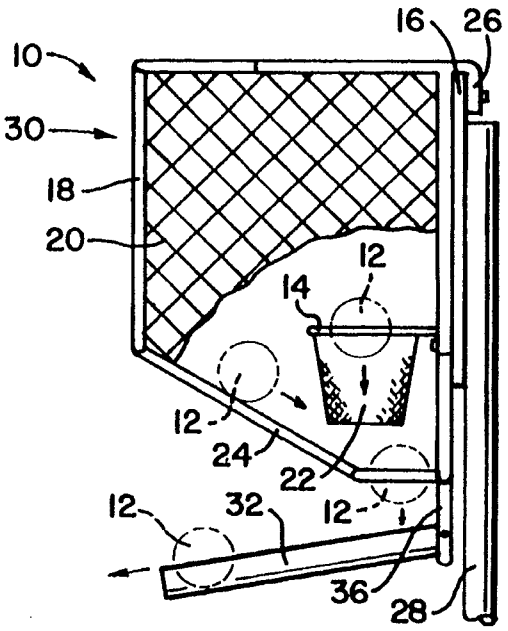
FIG. 2 is a side view of the basketball rebounding system of FIG. 1.
Figure 3:
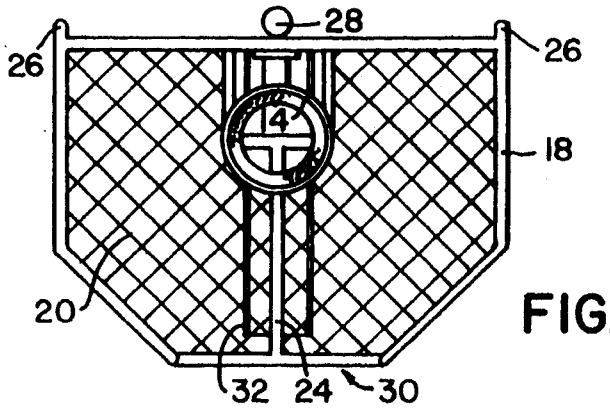
FIG. 3 is a top view of the basketball rebounding system of FIG. 1.
Figure 1:
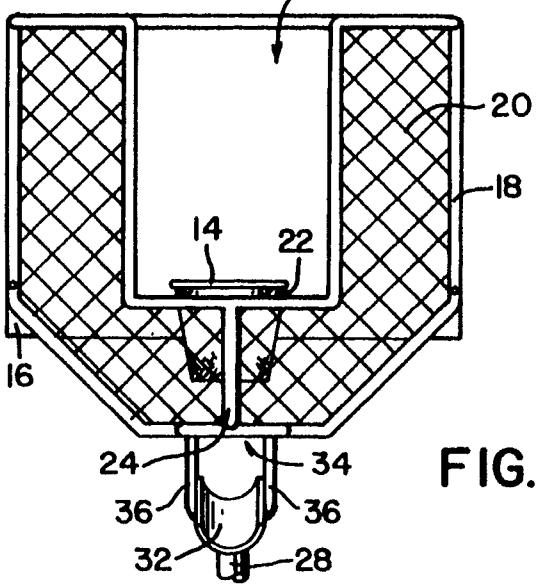
FIG. 1 is a front view of a basketball rebounding system in accordance with a first embodiment of the present invention.
Figure 4:
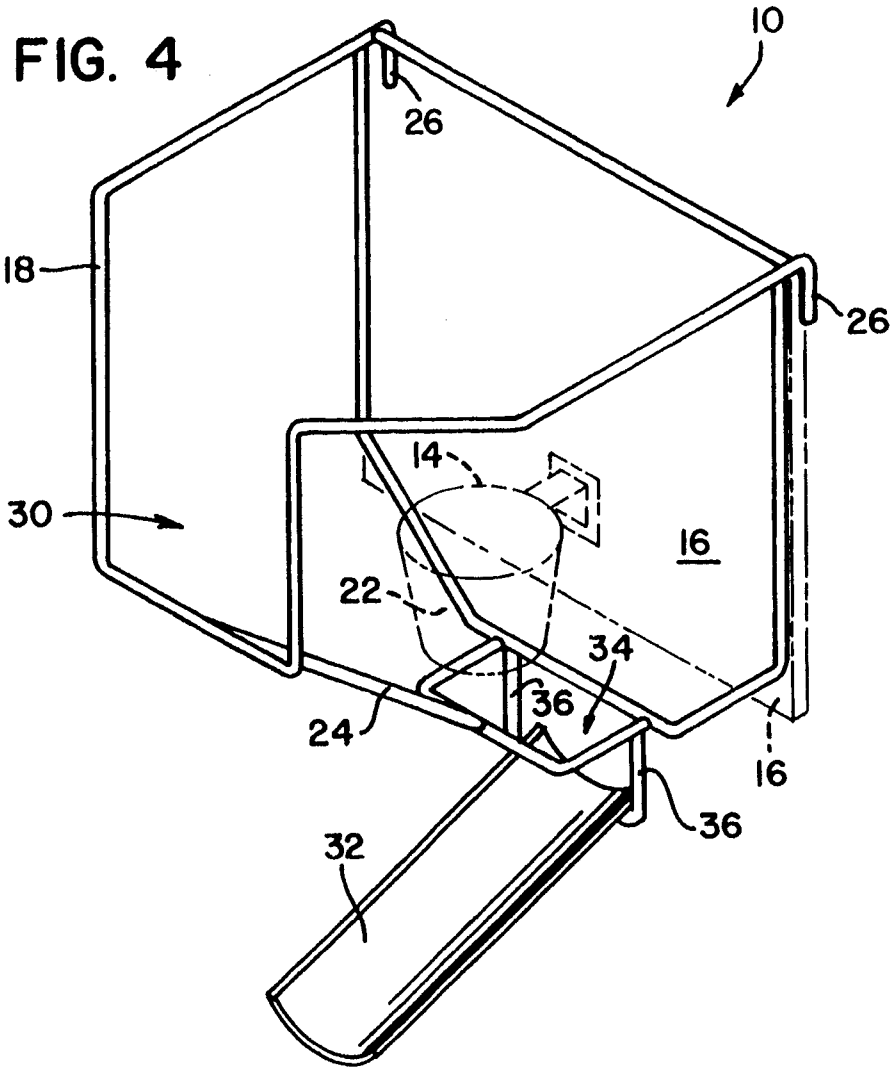
FIG. 4 illustrates the framework of the basketball rebounding system of FIG. 1, sans netting, and the attachment thereof to a conventional basketball hoop and backboard arrangement.

Referring now specifically to the drawings, there are illustrated two embodiments of a basketball rebounding system in accordance with the present invention, wherein like reference numerals refer to like elements throughout the drawings.

A first embodiment of the basketball rebounding system, generally designated as 10, is illustrated in FIGS. 1–4. More specifically, the basketball rebounding system 10 is adapted to capture and return a basketball 12 to the shooter thereof, regardless of the successful completion of a basket, by substantially enclosing the front, sides and bottom of a basketball hoop 14 and backboard 16.

The basketball rebounding system 10 comprises a framework 18 which is covered by a foraminous netting material 20, thereby forming a "basket" for capturing a basketball directed therein by a shooter. As illustrated, the sides, front and bottom of the framework 18 are overlaid with the foraminous netting material 20, with the top of the framework 18 remaining unobstructed. The framework 18 extends outwardly from opposing sides of the backboard 16, projects beyond the front rim of the basketball hoop 14, and extends downwardly below the bottom of the basketball net 22 and backboard 16. A stabilizing bar 24 is provided to stabilize the anterior section of the framework 18. Securing flange members 26 are utilized to removably secure the basketball rebounding system 10 over the top of the backboard 16. Of course, other securing techniques may be utilized to suitably attach the system 10 to the backboard 16 and/or backboard support 28.

The anterior section of the framework 18 is configured in the form of a rectangular slot 30 to allow for the passage of a basketball therethrough toward the basketball hoop 14 and backboard 16. As illustrated, the slot 30 is fixedly and centrally disposed in front of the basketball hoop 14, parallel to the backboard 16, has a width slightly larger than the diameter of the basketball hoop 14, and extends upward from a point slightly below the level of the basketball hoop 14. As such, a basketball which has been shot perpendicularly toward the basketball hoop 14 will generally pass through the slot 30 without encountering the framework 18 of the basketball rebounding system 10. Thereafter, as specifically detailed in FIG. 2, the foraminous netting material 20 surrounding the front, sides and bottom of the framework 18 will capture and direct the basketball 12 onto an underlying return mechanism 32 through an aperture 34, regardless of the successful completion of a basket. Generally, the basketball 12 will either pass through the basketball hoop 14, ricochet off the basketball hoop 14 and/or backboard 16 against a section of the foraminous netting material 20, or fall directly onto the foraminous netting material 20 enclosing the bottom of the basketball rebounding system, before passing through the aperture 34.

Mounts 36 are utilized to secure a first end portion of the return mechanism 32 to the framework 18, with the second, opposing end portion of the return mechanism directed perpendicularly outward from the backboard 16 and slot 30. Accordingly, a captured basketball will be returned to the shooter thereof substantially along the original flight path of the basketball. To modify the return velocity of the basketball 12, the return mechanism 32 may be pivotally secured to mounts 36 at pivot point 37.

Referring now specifically to FIGS. 5–10, there is illustrated a second embodiment of a basketball rebounding system, generally designated as 40, in accordance with the present invention. More specifically, the basketball rebounding system 40 includes a rotatable, slotted structure 42 for substantially enclosing the front and sides of a basketball hoop 14 and backboard 16, and a netted framework 44 for substantially enclosing the bottom of the hoop and backboard. As in the first embodiment of the present invention, the rotatable structure 42 and netted framework 44 form a "basket", having an open top, for capturing a basketball directed therein by a shooter, regardless of the successful completion of a basket. The rotatable structure 42 extends annularly outward from opposing sides of the backboard 16, projects beyond the front rim of the basketball hoop 14, and includes a rotatable ball entry slot 46. The netted framework 44 extends downwardly below the bottom of the basketball net 22 and backboard 16, and includes a stabilizing support bar 48 for supporting the anterior section of the rotatable, slotted structure 42. An aperture 50, disposed at the bottommost section of the netted framework 44, is utilized to direct a captured basketball onto a rotatable return mechanism 52. The basketball rebounding system 40 may be secured to the backboard 16 and/or backboard support 28 in any manner known in the art. Advantageously, the rotatable ball entry slot 46 and the rotatable return mechanism 52 allow a player to practice shots from various positions about the basketball hoop 14.

Figure 7:
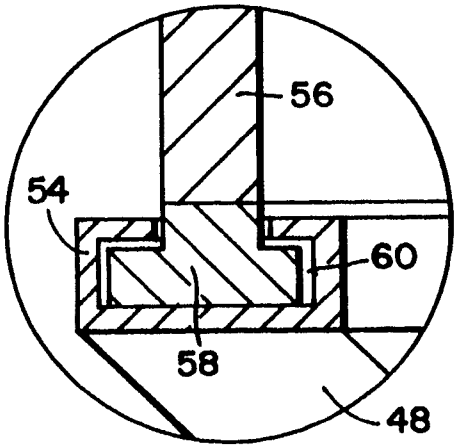
FIG. 7 is an enlarged, cross-sectional view of the movable engagement between an end section of an upwardly extending, horizontally movable support and the annular track.
Figure 6:
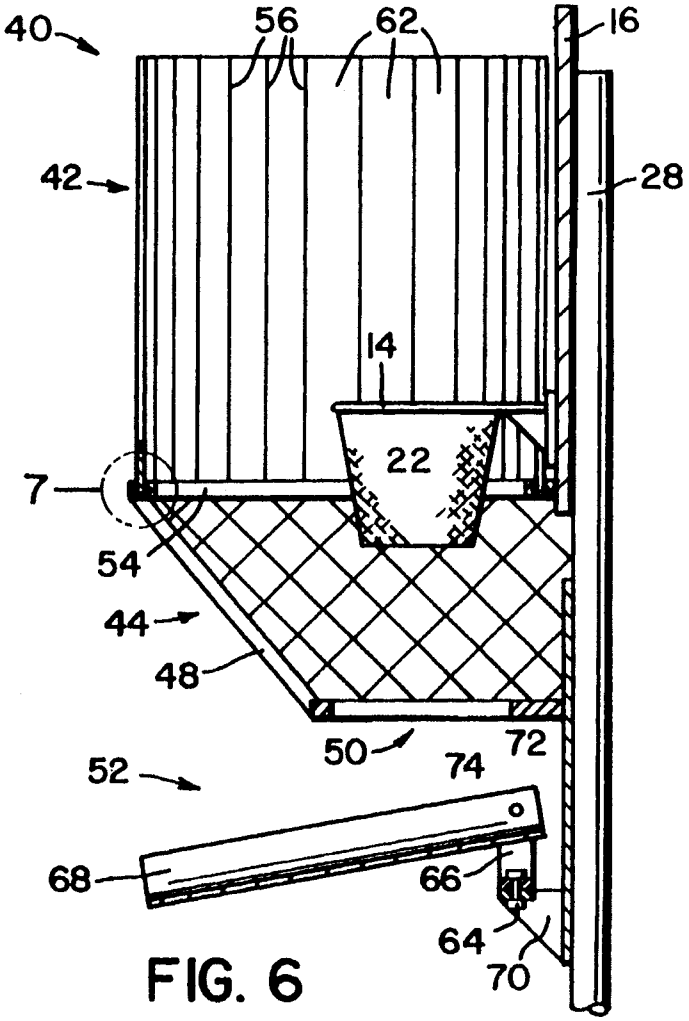
FIG. 6 is a side cross-sectional view of the basketball rebounding system of FIG. 5.
Figure 5:
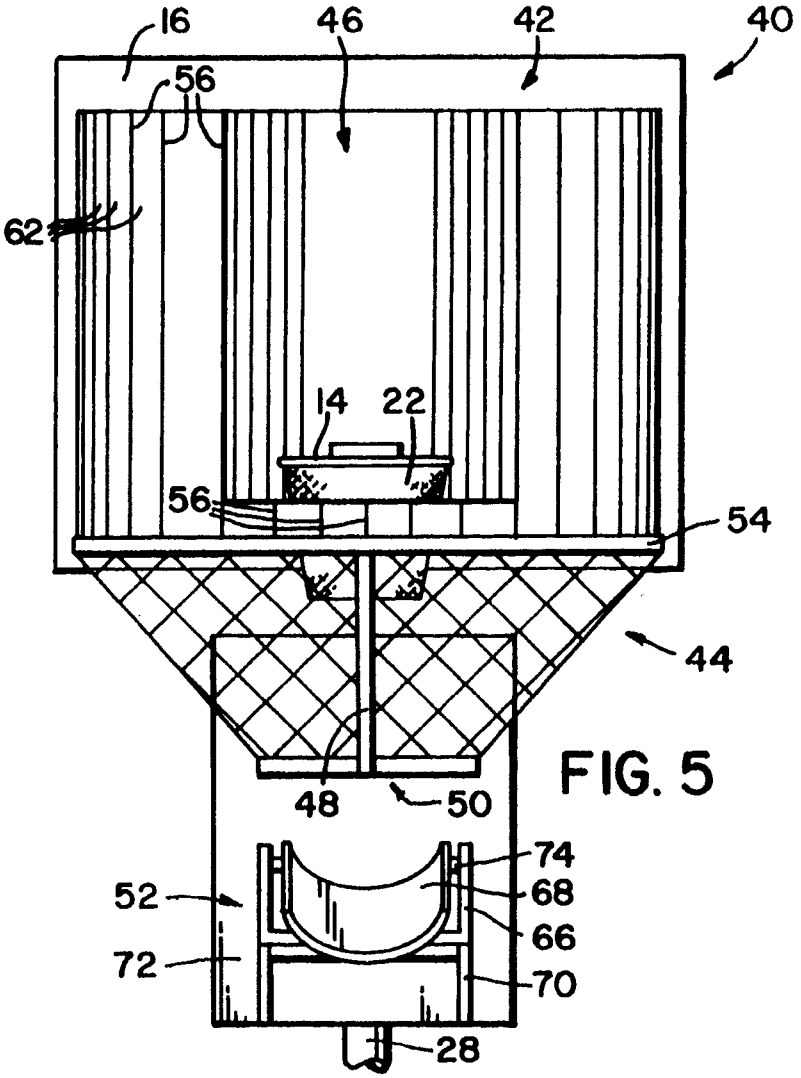
FIG. 5 is a front view of a basketball rebounding system in accordance with a second embodiment of the present invention.

The basketball rebounding system 40 includes a substantially annular, channeled track 54 for slidably engaging the rotatable structure 42, wherein the rotatable structure 42 comprises a plurality of horizontally movable, upwardly extending, coupled supports 56. The rotatable ball entry slot 46 is formed by a contiguous, shorter subset of the coupled supports 56. As depicted in FIG. 7, each support 56 includes an inverted, T-shaped lower end section 58 which is slidably received within an internal channel 60 in the annular track 54.

Figure 8:
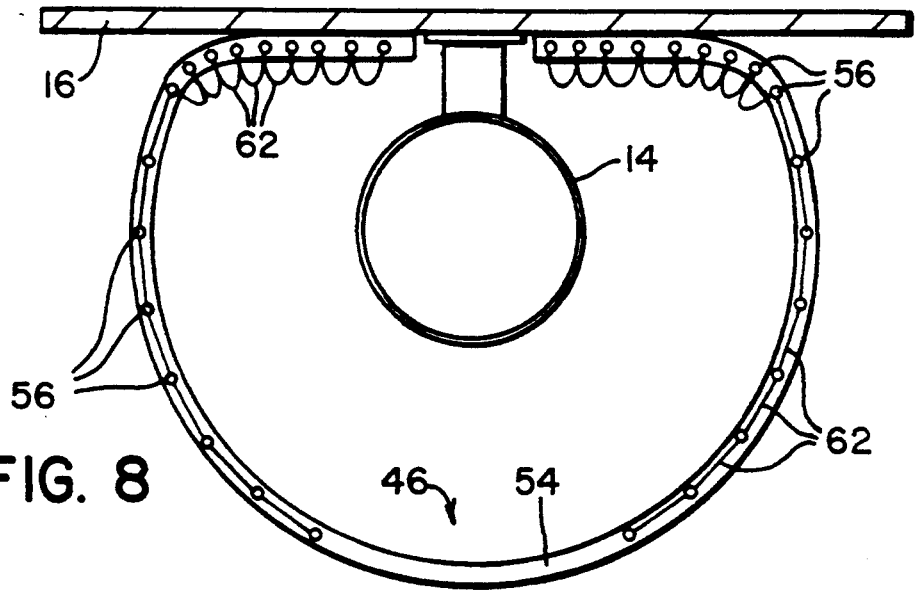
FIGS. 8–10 illustrate the rotatable movement of the basketball receiving slot about the substantially annular track.
Figure 9:
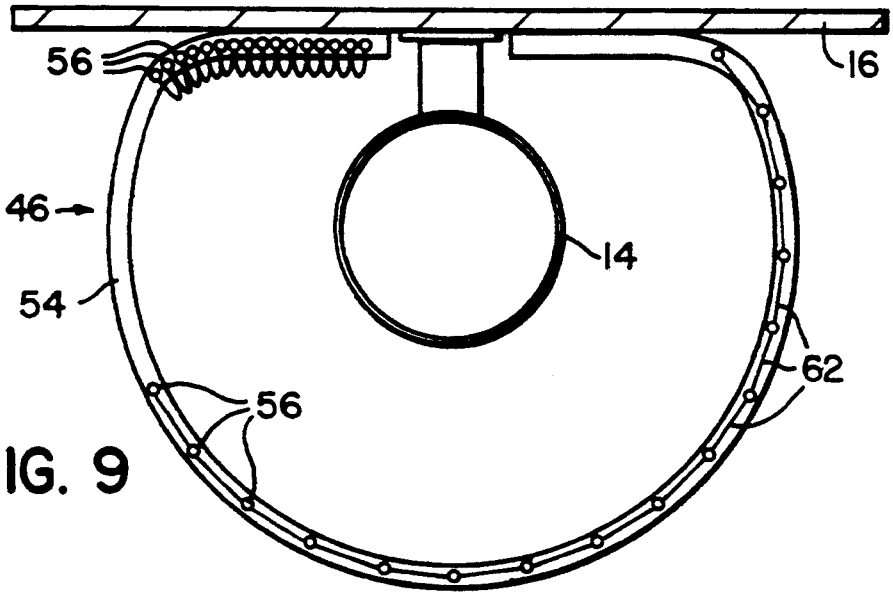
Figure 10:
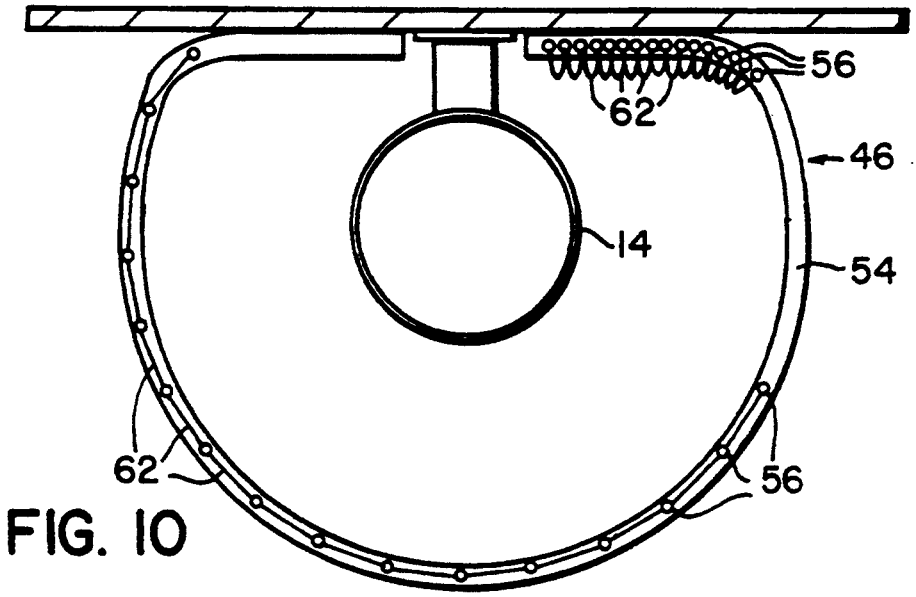

Adjacent ones of the supports 56 are coupled by a flexible plastic or foraminous material 62, thereby allowing sections of the collapsible structure to be gathered together as the slot 42 is rotated about the track (see FIGS. 8–10). Alternately, adjacent ones of the supports 56 may be pivotally coupled by at least one discrete pivotable element.

The rotatable, slotted structure 42 is adapted to be manually rotated through an arc of up to 180° around the annular track 54 to position the slot 46 substantially perpendicular to a player, thereby allowing the player to practice shots from various positions about the basketball hoop. Correspondingly, the rotatable return mechanism 52 may be horizontally rotated according to the position of the slot 46 to return a captured basketball to the player substantially along the original flight path of the basketball. More specifically, the rotatable return mechanism 52 includes a vertically oriented pivot element 64 for movably coupling a rotatable mount 66, having a first end portion of a substantially rigid, elongated, arcuate return chute 68 fastened thereto, to a stationary mount 70. Preferably, a downwardly extending plate 72 or the like is utilized to secure the stationary mount 70 to the netted framework 44. Further, the angle of return and the resultant return velocity of a captured basketball may be modified by pivotally securing a first end portion of the return chute 68 to the rotatable mount 66 about horizontal pivot points 74.

The foregoing description of the preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

I claim:

1. A basketball rebounding system for attachment to a basketball arrangement including a basketball hoop and backboard, comprising:

a basketball capture apparatus for anteriorly enclosing said backboard and said basketball hoop, said capture apparatus extending outwardly around and beneath said basketball hoop from said backboard, said capture apparatus further including a ball entry slot, disposed in front of said basketball hoop, for receiving a basketball therethrough, wherein said ball entry slot includes opposed, substantially vertically extending side members, and a substantially horizontally extending base member which extends between a bottom portion of each said side member, and wherein said base member is disposed in front of and slightly below said basketball hoop; and a ball return mechanism for returning a basketball captured by said capture apparatus toward a shooter thereof;

said basketball capture apparatus further including an apertured bottom portion for directing said captured basketball onto said ball return mechanism, and a support member, extending between a center section of said base member and a front section of said apertured bottom portion, for stabilizing said ball entry slot.

2. The basketball rebounding system according to claim 1 further including:

mounting elements for securing said basketball capture apparatus to said basketball arrangement independently of said basketball hoop.

3. The basketball rebounding system according to claim 1 wherein said ball return mechanism includes an elongated, arcuate chute, and wherein a first end portion of said chute is pivotally mounted about a horizontal axis to said basketball capture apparatus.

4. The basketball rebounding system according to claim 1 wherein said basketball capture apparatus forms a basket, having an open top, which extends anteriorly around said basketball hoop and backboard, and wherein said basketball capture apparatus is adapted to capture a basketball directed therein through said ball entry slot, even when said basketball does not successfully pass through said basketball hoop.

5. The basketball rebounding system according to claim 1 wherein said ball return mechanism includes an elongated, arcuate chute, and wherein a first end portion of said chute is pivotally mounted about a vertical axis to said basketball capture apparatus.

6. The basketball rebounding system according to claim 5 wherein the first end portion of said chute is pivotally mounted about a horizontal axis to said basketball capture apparatus.

7. A basketball rebounding system for attachment to a basketball arrangement including a basketball hoop and backboard, comprising:

a basketball capture apparatus for anteriorly enclosing said backboard and said basketball hoop, said capture apparatus extending outwardly around and beneath said basketball hoop from said backboard, said capture apparatus further including a ball entry slot, disposed in front of said basketball hoop, for receiving a basketball therethrough, and a system for rotatably positioning said ball entry slot about said basketball hoop; and a ball return mechanism for returning a basketball captured by said capture apparatus toward a shooter thereof;

wherein said basketball capture apparatus further includes a rotatable structure formed of a coupled series of upwardly extending, horizontally movable supports, said ball entry slot being formed of a shorter subset of said supports, and wherein said slot positioning system includes a track for movably receiving an end portion of each said support therein.

8. The basketball rebounding system according to claim 7 wherein said basketball capture apparatus further includes:

an apertured bottom portion for directing said captured basketball onto said ball return mechanism.

9. The basketball rebounding system according to claim 7 wherein said ball return mechanism includes an elongated, arcuate chute, and wherein a first end portion of said chute is pivotally mounted about a horizontal axis to said basketball capture apparatus.

10. The basketball rebounding system according to claim 7 wherein said ball return mechanism includes an elongated, arcuate chute, and wherein a first end portion of said chute is pivotally mounted about a vertical axis to said basketball capture apparatus.

11. The basketball rebounding system according to claim 10 wherein the first end portion of said chute is pivotally mounted about a horizontal axis to said basketball capture apparatus.

12. A basketball rebounding system for attachment to a basketball arrangement including a basketball hoop and backboard, comprising:

a basketball capture apparatus for anteriorly enclosing said basketball hoop, said capture apparatus extending outwardly around and beneath said basketball hoop from said backboard, said basketball capture apparatus further including a rotatable ball entry slot for receiving a basketball therethrough, and a system for rotatably positioning said rotatable ball entry slot about said basketball hoop; and a rotatable ball return mechanism for returning a basketball captured by said capture apparatus toward a shooter thereof;

wherein said slot positioning system includes a rotatable structure formed of a coupled series of upwardly extending, horizontally movable supports, said ball entry slot being formed of a shorter subset of said supports, said slot positioning system further including a track for movably receiving an end portion of each said support therein.

13. The basketball rebounding system according to claim 12 wherein said basketball capture apparatus further includes:

an apertured bottom portion for directing said captured basketball onto said ball return mechanism.

14. The basketball rebounding system according to claim 12 wherein said rotatable ball return mechanism includes an elongated, arcuate chute, and wherein a first end portion of said chute is pivotally mounted about a horizontal axis to said basketball capture apparatus.

15. The basketball rebounding system according to claim 12 wherein said rotatable ball return mechanism includes an elongated, arcuate chute, and wherein a first end portion of said chute is pivotally mounted about a vertical axis to said basketball capture apparatus.

16. The basketball rebounding system according to claim 15 wherein the first end portion of said chute is pivotally mounted about a horizontal axis to said basketball capture apparatus.

* * * * *